United States Patent [19]

Arduini et al.

[11] 4,167,548

[45] Sep. 11, 1979

[54] PROCESS FOR THE MANUFACTURE OF A MICROFIBROUS PULP SUITABLE FOR MAKING SYNTHETIC PAPER

[75] Inventors: Guido Arduini, Cormano; Marcello Ghirga, Bresso; Gaspare Renda, Legnano, all of Italy

[73] Assignee: Societa' Italiana Resine S.I.R. S.p.A., Milan, Italy

[21] Appl. No.: 518,117

[22] Filed: Oct. 25, 1974

[30] Foreign Application Priority Data

Nov. 8, 1973 [IT] Italy ..... 31051 A/73

[51] Int. Cl.[2] ..... B22D 23/08

[52] U.S. Cl. ..... 264/12; 162/157 R; 264/140

[58] Field of Search ..... 264/205, 93, 12, 14, 264/DIG. 75, 140; 162/157 R

[56] References Cited

U.S. PATENT DOCUMENTS

| | | | |
|---|---|---|---|
| 2,297,725 | 10/1942 | Stephanoff | 34/10 |
| 2,336,743 | 12/1943 | Manning | 264/DIG. 75 |
| 2,357,392 | 9/1944 | Francis | 264/DIG. 75 |
| 2,411,660 | 11/1946 | Manning | 264/DIG. 75 |
| 2,433,000 | 12/1947 | Manning | 264/DIG. 75 |
| 2,437,263 | 3/1948 | Manning | 264/DIG. 75 |
| 2,967,327 | 1/1961 | Ladisch | 65/5 |
| 3,015,127 | 1/1962 | Stalego | 264/DIG. 75 |
| 3,017,664 | 1/1962 | Ladisch | 264/DIG. 75 |
| 3,309,734 | 3/1967 | Bynum et al. | 264/102 |
| 3,808,091 | 4/1974 | Aoki et al. | 162/157 R |
| 3,879,335 | 4/1975 | Storck et al. | 260/42.55 |
| 3,885,014 | 5/1975 | Fukada et al. | 264/205 |
| 3,914,354 | 10/1975 | Ueki et al. | 264/13 |
| 3,937,772 | 2/1976 | Urban et al. | 264/140 |
| 4,013,744 | 3/1977 | Kuerten et al. | 264/14 |

FOREIGN PATENT DOCUMENTS

| | | | |
|---|---|---|---|
| 787032 | 1/1972 | Belgium | 264/13 |
| 787033 | 1/1973 | Belgium | 264/10 |
| 49-50212 | 5/1974 | Japan | 162/157 R |
| 1124578 | 8/1968 | United Kingdom | 264/184 |

*Primary Examiner*—Jay H. Woo

*Attorney, Agent, or Firm*—Sughrue, Rothwell, Mion, Zinn and Macpeak

[57] ABSTRACT

A microfibrous pulp suitable for use in the manufacture of synthetic paper is prepared by forming an aqueous emulsion of a solution in an organic solvent of olefinic homopolymers and copolymers and copolymers of at least one olefinic monomer with at least one further monomer copolymerizable therewith, heating the emulsion above the melting point of the polymers and spraying emulsion into a zone of expansion in which water and the organic solvent are evaporated. The hot emulsion is sprayed in the form of a tubular jet in the cavity of which a stream of inert gas is injected to spread the jet transversally in the zone of expansion.

23 Claims, 2 Drawing Figures

PROCESS FOR THE MANUFACTURE OF A MICROFIBROUS PULP SUITABLE FOR MAKING SYNTHETIC PAPER

BACKGROUND OF THE INVENTION

1. Field of the Invention

The invention relates to a process for preparing pulp of a microfibrous structure suitable for use in manufacturing synthetic paper.

The pulp shall be referred to hereafter for the sake of simplicity as microfibrous pulp.

2. Description of the Prior Art

It is known that in manufacturing conventional paper cellulose pulp is employed. The increasing paper consumption, which grows exceptionally, and the increasing depletion of world forestry supplies, justify the concern that manufacture of cellulose pulp may soon prove insufficient to meet requirements.

For this reason the proposal was made to manufacture paper from synthetic polymeric compounds. To this end a number of processes have been developed for obtaining synthetic materials which have been termed synthetic papers on account of their resemblance to paper both in aspect and printing behaviour.

One of the best known techniques is the manufacture of synthetic papers from film or, more simply, of plastics paper.

By this technique a polymer, which is usually selected from high density polyethylene and polystyrene, is converted to a film, then generally drawn in two orthogonal directions.

In order to make the film similar to paper from cellulose pulp, and suitable for the same use, the starting polymer or the biaxially drawn film are subjected to special treatments.

More particularly, before extrusion the polymer may be admixed with fillers, and above all with pigments such as titanium dioxide, silicon dioxide and calcium carbonate or it may be admixed with swelling agents.

The plastics paper obtained from pigmented film is among the simpler and less expensive ones but suffers from certain not negligible drawbacks, such as the formation of inner weak regions due to unsatisfactory homogenization of the pigment, lower biaxial orientation of the film, unsatisfactory opacity values, unsatisfactory ink receptive properties and attitude towards printing, formation of electrostatic charges during processing. Better results in respect of opacity and printing attitude generally are obtained by admixing the polymer before extrusion with swelling agents which create micropores distributed throughout the thickness of the plastics paper.

The porous structure confers to the plastics paper properties extremely similar to those of cellulose pulp paper but considerably lowers its mechanical properties.

The biaxially drawn film can be made similar to paper by suitable surface treatments (paperization), of a mechanical or chemical nature, or it is coated on both sides with adhesive substances containing opacifying agents.

However, the resulting products are not homogeneous in the direction of thickness, namely they comprise layers of different materials each of which imparts to the product specific properties, the mechanical properties depending upon the intermediate layer, the optical properties and printing attitude depending upon the surface layers. This makes more difficult and delicate any further treatment to which the plastics paper will be subjected, and in particular printing.

Generally, however, as compared with cellulose paper, the plastics paper deriving both from treatment of the polymer and surface treatment of the biaxially drawn film, is of improved properties in respect of water and chemical reagent proofness, tensile strength, dimensional stability and winding attitude.

Among the drawbacks, in addition to those mentioned above, a low tear strength, low folding attitude due to impermeability to air and high manufacturing cost should be mentioned.

On account of these drawbacks plastics paper is employed for special purposes only, above all for uses which take advantage of proofness against both creasing and water and warrant the high costs; especially posters, placards, foldable labels and advertising leaflets.

A further known technique is the manufacture of synthetic paper from continuous filaments or, more simply, "spun bonded" paper.

This article consists of a felt of continuous filaments, the individual fibers of which are glued together at various locations and are uniformly arranged in all directions.

In order to manufacture spun bonded paper the melted polymer is extruded through the orifices of a spinneret in a way similar to conventional processes of manufacturing synthetic fibers.

The thread is continuously drawn then laid on a band where it is submitted to a thermal-mechanical treatment to cause the resulting paper to acquire the desired extent of compactness. The spun bonded paper may further be coated with a suitable lacquer which improves its printing attitude. The important advantage of spun bonded paper is that such papers are obtained by a continuous process with a high production rate. The spun bonded paper is very similar in appearance to a non-woven fabric and has therefore to be submitted to a number of tedious treatments to confer to it an appearance similar to that of cellulose pulp paper.

The cost of manufacture of the spun bonded paper is very high so that the latter also is used only for special purposes such as wall paper, labels and book-covers.

A further known technique is the manufacture of synthetic paper from staple fibers. This method is carried out by either a dry or a wet process. By the dry method staple fibers conventionally prepared from the polymer, a few millimeters or a few centimeters in length, are dispersed for instance by an aerodynamic system. The resulting separate fibers are blown by a gas stream against a paper forming surface to form a sort of felt consisting of variously interlaced fibers.

The resulting material is of low tensile strength thus necessitating a partial adhesion of the individual fibers at their interconnecting and interlocking points by fusing them together. In order to improve adhesion, adhesive substances are also resorted to, which can for instance be spread as latexes on the final article or interlaced with the staple fibers as binding fibers fusible during the end heat treatment.

However, this process is but little used on account of the difficulty of obtaining uniform thicknesses and of the deficient paper properties of the final product in respect to both appearance and mechanical properties.

By the wet method the staple fibers are initially suspended in water and subsequently opened and dispersed by means of the water itself. This step is followed by a process similar to the preparation of cellulose paper from cellulose suspensions.

This method is ditinguished by a high production rate and uniformity in thickness of the resulting product but still suffers from a number of drawbacks.

More particularly, the staple fibers, namely bundles of a number of $10^3$ up to $10^6$ interconnected fibers should be opened and fibrillated. This usually necessitates a turbulence arrangement. On the contrary, conveying of the suspension of material is advantageously effected by a laminar stream.

Since these requirements can hardly be met, the process should be carried out with a low density of material, namely a small number of fibers per unit of volume water, in order to avoid re-forming of the bundles, which adversely affects the standard of the final product.

Further drawbacks derive from the fact that the cellulose fibers and staple fibers so radically differ from each other that the latter cannot practically be processed by the equipment existing in cellulose pulp paper manufacturing factories.

More particularly, conventional cellulose fibers possess the necessary fundamental properties for making paper sheets, namely they are easily dispersible in water in a uniform manner, are of sufficient length, generally 3 to 6 mm, this length being uniform so that the resulting webs are of a satisfactory strength, and they can moreover be fibrillated and form hydrogen bonds.

On the contrary, synthetic fibers do not possess any of these properties.

The length of synthetic staple fibers generally exceeds 6 mm and the fibers hardly are of a substantially uniform length and most frequently are fused together at their ends.

Finally, since the bundles are deriving from cutting continuous filaments, the so-called tows, generally employed in the textile field, the fibers composing them are usually curled. This all gives rise to heavy drawbacks, as the fibers under these conditions tend to bind together and form entanglements and knots in the finished sheet.

Synthetic fibers are difficult to suspend uniformly in water due to their high water repellent properties so that the suspending medium must be admixed with a surfactant.

Since synthetic fibers can hardly be fibrillated, some steps of the process of manufacture of cellulose paper must necessarily be omitted, more particularly the bending step, for they would degrade the fiber.

Further drawbacks derive from the fact that in conventional paper-making equipment the synthetic fibers tend on account of their above-described properties to become interlaced and form accumulations and obstructions.

For this reason the wet process can hardly be carried out with conventional paper-making equipment for processing cellulose pulp.

The properties of the paper made from fibers by the wet process are not quite satisfactory either, more particularly in respect of tensile strength.

For all these reasons, though the wet process is theoretically of a considerable interest, it could not be widely employed in the paper field, while it was utilized for manufacturing non-woven fabrics used above all in the textile field, such as disposables (handkerchiefs, napkins, disposable articles of wear, pieces of linen), supports for impregnation and coating, felts and the like.

Recently, much work was devoted to the development of synthetic microfibers, representing actual chemical pulps easy to use in paper pulps as a generally partial substitute for cellulose pulp. Processes have been developed which are essentially based on dissolving under pressure polymeric compounds, generally of the polyolefin type, in an organic solvent and on spraying the resulting solution through a nozzle into a medium maintained under conditions of temperature and pressure such as to evaporate the solvent. The result is a synthetic pulp which can be blended with cellulose pulp for the manufacture of paper.

One of the advantages of this technique is that the paper production cycle is not changed as mixtures of cellulose pulp and synthetic pulp do not imply substantial changes in the paper manufacturing line.

The process for the production of microfibrous synthetic pulps as described above, however, suffers from non-negligible drawbacks. Firstly, the cost is very high on account of the restricted possibility for selecting a suitable solvent, the large quantities of solvent required, hence the cumbersome recovery steps and care required by the various processing steps. However, the main drawback resides above all in the fact that the use of microfibrous pulps prepared by such process is not at all simple in the manufacture of paper. For this reason, for instance, synthetic pulps obtained by employing an organic solvent cannot fully replace cellulose pulp, but are always utilized blended with the latter, usually in very small proportions. This is probably all imputable to the fact that the microfibers composing the synthetic pulp obtained when using an organic solvent do not possess hydrophilic properties and can therefore hardly be put in suspension in water, are of low homogeniety and highly differ in structure from cellulose microfibers so that they are ultimately hardly compatible with the latter. Finally, the product obtained by spraying is frequently in the form of a fibrous mass of a continuous structure, which cannot be disaggregated by conventional means into elementary microfibers and is highly swollen by the solvent, its properties being therefore such that it cannot be converted to sheets by conventional paper-making techniques.

Processes were further proposed, which are essentially based on the initial preparation of aqueous emulsions of solutions of polymeric compounds which are crystalline at high temperature and pressure and subsequent spraying of the emulsions in a medium at lower temperature and pressure.

This results in crystalline microfibers, which therefore a high extent of molecular orientation, and highly fibrillated.

As compared with the products obtained by employing an organic solvent, these microfibers are distinguished by a by considerable improvement in their capacity for being put in suspension in water, compatibility with cellulose pulp and possibility of use in the paper field by conventional techniques.

It is therefore believed that a highly important condition for using synthetic microfiber pulps in the paper-making field is to provide microfibers of a very high orientation extent. The latter technique, however, also suffers from not negligible drawbacks. More particularly, spraying does not directly yield elementary microfibers, as required for use in the paper-making field, but rather a fibrous aggregate which cannot be directly employed in preparing paper without being disaggregated into its elementary microfibers; to this end, however, tedious mechanical operations, which are not easy to accomplish, are necessary.

Moreover, these microfibrous pulps, though giving better results in the paper field than the microfibrous pulps obtained with the use of an organic solvent, are employed for the purpose mostly only in a blend with cellulosic pulp which is in any case still the component present in a larger proportion in the blend.

Finally, paper sheets obtained by utilizing synthetic pulp alone, prepared by aqueous emulsion without any addition of cellulosic pulp, are of a very low consistency and require for use further treatments which would make the process cumbersome.

SUMMARY OF THE INVENTION

As distinct from the above-described processes the invention has for its main object the preparation of a synthetic microfibrous pulp for the manufacture of paper, which is free from the above described drawbacks and comes very near it properties to cellulosic pulp.

A further object of the invention is to provide a process for making a synthetic microfibrous pulp suitable for replacing fully or in part cellulose pulp in making paper.

Thus, the invention provides a process for preparing a microfibrous pulp suitable for use in the manufacture of synthetic paper by forming an aqueous emulsion of a solution of a synthetic polymerization product in a relatively volatile organic solvent and spraying the emulsion into a zone in which water and the organic solvent are evaporated from the spray, characterized in that:

(a) the polymerization product consists of at least one polymer having a molecular weight of from $10^3$ to $10^6$ chosen among olefin homopolymers, copolymers of olefins and copolymers of at least one olefin monomer with at least one further monomer copolymerizable therewith;

(b) the emulsion is heated before spraying at a temperature above the melting point of the polymerization product;

(c) the hot emulsion is sprayed into the zone in the form of a tubular jet;

(d) a stream of inert gas is injected into the cavity of the tubular jet substantially coaxially with the latter to spread the jet transversally of its length.

Preferably, the stream of inert gas is injected co-currently with the tubular jet of emulsion at the root region of the jet.

BRIEF DESCRIPTION OF THE ACCOMPANYING DRAWINGS

In the accompanying drawings:

FIG. 1 is a schematic, longitudinal cross-sectional view of a nozzle for spraying the emulsion, and FIG. 2 is a schematic view of a spraying system comprising the nozzle of FIG. 1.

DETAILED DESCRIPTION OF THE INVENTION

Figure 1:
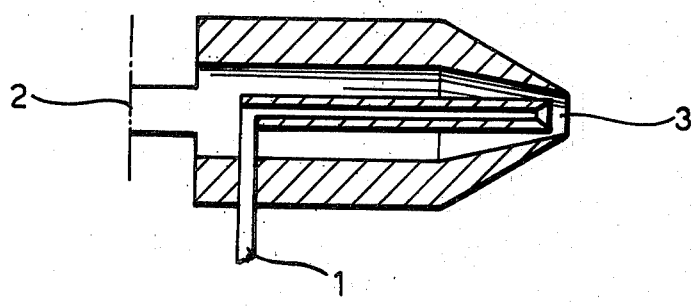

Spraying of the aqueous emulsion into the zone can be effected by conveying the emulsion up to the root region of the jet as a tubular stream encircling a separate central stream of inert gas, thus obtaining at the root region of the tubular jet a central stream of inert gas in intimate contact with the tubular jet.

Best results are obtained by causing the emulsion to flow towards the root region of the jet as a concentrical annular stream encircling a separate inert gas stream having a circular cross-section.

By proceeding under the conditions of the invention, the requirements for making a microfibrous pulp suitable for paper-making are advantageously obtained by contacting an inert gas stream having at the root region of the jet a circular cross-section of from 0.5 to 5 mm in diameter with a concentrical tubular stream of emulsion having at the root region of the jet a cross-sectional area from 0.1 to 10 sq.mm.

In a practical embodiment of the process according to this invention the emulsion is sprayed from an annular orifice and is contacted with the inert gas stream at a location close to the orifice whereby a tubular flow of emulsion directed to the orifice encircles the gas stream, and whereby the tubular jet of emulsion sprayed from the orifice is expanded and caused to burst by the stream of gas.

By operating in this manner and, preferably, under the conditions described hereafter a microfibrous pulp is obtained which can be directly employed in the manufacture of paper by conventional techniques, either alone or mixed with cellulose pulp, without requiring mechanical operation for subdividing the microfibers constituting the pulp.

The resulting microfibrous pulp is ditinguished by its easy aptitude to be suspended in water, its compatibility with cellulose pulp and by yielding, alone or blended with cellulose pulp, stable homogeneous aqueous suspensions.

By proceeding according to the present invention an amorphous microfibrous pulp is obtained starting from polymers, either crystalline or non-crystalline.

The term amorphous microfibrous pulp means a pulp of a degree of crystallinity measured by X rays below 50%, mostly below 30%. Therefore, the microfibers constituting the microfibrous pulp according to the present invention are distinguished by a very low degree of orientation.

Contrary to the teachings of the prior art, it was found that the amorphous microfibrous pulp obtained according to the invention has not only excellent properties from the point of view of paper-making, but yields papers which are superior in appearance and mechanical and optical properties to crystalline microfibrous pulps.

Though no theory needs be expressed, it is believed that the bursting action of the emulsion "tube" at the outlet of the orifice, due to quick evaporation of the solvent and water, together with the use of inert gas under the conditions of the process, brings the emulsion on issuing from the orifice into a subdivided state such as to promote formation of individual non-aggregated microfibers, of a structure and of properties which are compatible with cellulose pulp.

Whichever the mechanism involved, the process of the invention yields in a simple and convenient manner pulps consisting of non-aggregated microfibers of properties not obtainable by known processes.

It should be further noted that the effect of the inert gaseous flow is active also on polymer solutions in an organic solvent.

However, as distinct from the use of emulsions, no microfiber pulps of desirable properties for the purposes indicated hereinbefore are obtained.

The polymerization product used in the process according to the invention can be either of a crystalline or of a non-crystalline nature. The preferred polymerization products are homopolymers of ethylene, propylene and 1-butene; copolymers of two monomers at least selected among ethylene, propylene and 1-butene; copolymers of one or more monomers selected from ethylene, propylene and 1-butene with further copolymerizable monomers, such as vinyl acetate and vinyl chloride. The polymers and copolymers can be used alone or in the form of blends of two or more components. The best results for the purposes of the invention are obtained by utilizing crystalline polypropylene, and, above all, high density polyethylene.

High density polyethylene is prepared at low pressure, mostly as a solution or suspension in an organic solvent, typically in the presence of chromium trioxide or of a catalytic system consisting of a halogenated derivative of a transition metal, possibly of the supported type, in combination with an organometallic compound.

The polypropylene is prepared in a way similar to that of high density polyethylene, however only in the presence of a catalytic system comprising a halogenated derivative of a transition metal in combination with an organometallic compound (Ziegler system).

The polymers and copolymers may be prepared by introducing the monomers in the form of gases or liquids into the catalytic solution or suspension in an organic solvent, usually at a pressure between atmospheric pressure and 35 atm and at a temperature of 40° to 100° C. under conditions remote from saturation of the solvent. The inert organic solvent utilized may be, for instance, pentane, hexane, cyclohexane, heptane, benzene, toluene and monochlorobenzene, alone or jointly.

It is to be noted that, as has been found, preparation of a synthetic paper pulp from a solution, rather than from aqueous emulsion, of a polymer meets with difficulties arising from the presence in the polymer of catalyst residues which adversely affect the "paper" properties of the pulp. Therefore, when catalysts of the Ziegler type are employed for preparing polymers, namely non-supported catalysts obtained by contacting halogenated derivatives of transition metals with organometallic compounds, a tedious purification of the resulting polymer would be necessary. It was namely found that polyolefins, unless they are extremely pure, when dissolved in an organic solvent give rise to microfibers of deficient properties. Therefore, these polyolefins should be thoroughly purified. Traces of catalyst are tolerated, but the properties of the resulting microfibers are then not the best ones.

By proceeding according to the invention, that is in the presence of water, the catalysts are converted not only to substances which do not damage the polymer, hence the final microfibrous pulp, but also to substances useful as inert fillers when supported catalysts have been employed in polymerization.

Moreover, the presence of the suspended inert solids originating from the catalyst is not objectionable, owing to the presence of the inert gas stream which prevents obstructions and accumulations.

The starting polymerization products, in addition to the products directly derived from polymerization, can be also polyolefin products available on the market as well as wastes from manufacturing industries.

In no case the properties of the final pulp are substantially improved when the starting products are preliminarily purified from their catalyst content.

According to the invention an aqueous emulsion of a solution of the polymerization product in an organic solvent is initially prepared. It is preferred to prepare the emulsion so as to have therein a polymerization product content of from 5 to 35% by weight, preferably from 7 to 15% by weight, with respect to the organic solvent and a water content of from 0.2 to 2 kg, preferably from 0.5 to 1.5 kg to one liter of solution, of the polymerization product in the solvent.

To this end the emulsion can be prepared by initially dissolving the polymerization product in the organic solvent in the proportions required for the final emulsion and subsequently adding, while stirring, the necessary water or, alternatively, by directly contacting, while vigorously stirring, the water, solvent and polymer in the final required proportions. The emulsion to be sprayed is brought to a temperature above the melting point of the polymerization product. The pressure can be equal to the pressure value established in the system at the temperature involved, but should preferably exceed this value.

The choice of the temperature and pressure conditions in the first zone containing the emulsion depends in practice upon the temperature and pressure conditions in the zone into which the emulsion is sprayed. In any case quick evaporation of the solvent and water and at the same time formation of the microfibrous pulp should be afforded.

The temperature and pressure in the evaporation zone (expansion chamber) vary depending upon a number of factors (composition of the emulsion, nature of the polymer and solvent and the like), but generally are from 15° to 100° C. and from 0.5 to 1.5 abs. atm, respectively.

Generally, if the zone in which the microfibrous pulp is formed is at atmospheric pressure and ambient temperature (20°-25° C.) as is conveniently the case when employing the polymerization products described hereinbefore, a temperature of 150° to 250° C. and a pressure from 15 to 60 atm are maintained in the first zone containing the emulsion.

In order to reach and maintain these pressure conditions in the first zone, any pressure generator may be employed. For instance, a pressurizing gas not reacting with the emulsion may be employed or, alternatively, the emulsion may be heated in a closed zone till the desired pressure is reached by virtue of the evolved vapors. Still alternatively, a pump may be employed.

Suitable solvents for the polymerization product are organic solvents capable of uniformly dissolving the product without reacting therewith. More particularly, organic solvents of the following general properties are employed in a highly advantageous manner:

(a) under the temperature and pressure conditions ahead of the orifice the solvent should exhibit a strongly reduced solubility towards water and, whenever possible, be fully immiscible with water;

(b) under the conditions of temperature and pressure past the orifice (expansion zone) the solvent does not cause appreciable swelling of the polymerization products;

(c) within the limits of temperature from 150° to 250° C. and of pressure from 15 to 60 atm, the solvent-polymerization producing binary system exhibits a range of mutual solubility, at least for the range of polymer concentrations from 5 to 30% by weight.

Still more particularly, the preferred solvents can be aromatic hydrocarbons, such as benzene, toluene and xylene; aliphatic hydrocarbons such as n-butane, n-pentane, n-hexane, n-heptane, n-octane, isomers thereof and their distillation cuts, alicyclic hydrocarbons such as cyclohexane and methylcyclopentane, chlorinated hydrocarbons such as dichloromethane and chloroform. These solvents can be used alone or jointly.

Best results are obtained by utilizing n-heptane, methylcyclopentane or a mixture of both.

The emulsion can be admixed with a surfactant, above all in order to improve the stability of the emulsion and also to contribute towards the wet ability of the resulting microfibrous product in case the surfactant is in part at least dissolved in the product.

Depending upon the properties and physical state in which it is at the moment of use, the surfactant can be added either to the water, to the polymer or to the solvent or even directly to the emulsion before starting heating, in a quantity amounting to at least 0.2% but not exceeding 5% with respect to the weight of the polymerization product.

Surfactants of cationic, anionic, amphoteric and non-ionic character can be used but, especially when the microfibrous pulp is not to be submitted to post-treatments or additions for use as paper, non-ionic surfactants are preferred, such as, for instance, sorbitan polyoxyethylene monooleate and sorbitan monooleate.

However, the use of a surfactant is not critical for obtaining of the microfibrous pulp in the process according to the invention.

The emulsion can be advantageously admixed also with a filler such as calcium carbonate, talc and titanium dioxide. The filler is normally of a grain size below 1 micron and can be added in a quantity not exceeding 20% of the weight of the polymerization product. The filler improves the compactness and printability of the paper manufactured from the microfibrous pulp.

Depending upon the use for which papers manufactured from the microfibrous pulp are intended, the emulsion can be admixed also with a dye, an antioxidant, an antistatic agent, a flame propagation retardant or other substances known in the paper field.

The inert gas may be a gas which does not react under the above-mentioned conditions with the emulsion, preferably nitrogen, helium or a mixture of the two.

Preferably, per each liter of sprayed emulsion 0.1 to 1 $Nm^3$ inert gas are used at a pressure of 20 to 200 kg/sq. cm. and at a temperature which is typically room temperature (20°-25° C.) but may be higher if necessary.

Spraying of the aqueous emulsion from the high pressure zone to the low pressure zone is advantageously effected through a small orifice provided with means affording direct contact of the emulsion with the inert gas stream close to the orifice and causing the emulsion to travel through the orifice in the form of a tubular flow coaxially surrounding the inert gas stream.

Best results are obtained by a device having two circular concentrical passages, the inner of which, has the inert gas stream flowing therethrough, while the outer one, conveys the flow of emulsion.

Preferably, at the discharge end, the inner passage has a diameter of 0.5-5 mm and the cross-sectional area of the outer passage is from 0.1 to 10 sq.mm.

In the embodiment shown in FIG. 1, the inert gas entering the tube 1 is contacted close to the orifice 3 with the emulsion supplied by tube 2.

The configuration of the device is such that the emulsion flows around the tube 1, then comes into contact with the gas close to the orifice 3 and flows through the latter towards the expansion zone in the form of a liquid "tube" encircling the inner inert gas stream.

At the outlet from the orifice 3 into the expansion zone the emulsion "tube" is expanded by the gas stream and bursts to a finely subdivided condition which gives rise to the microfibrous pulp of the described properties.

More particularly, the emulsion is forced to travel through the orifice 3 in the form of a tubular flow the cross-sectional area of which is from 0.1 to 10 sq.mm, and the flow directly contacts the inert gas stream in the short interval between the free end of the tube 1 and the orifice 3, the initial diameter of the gas stream being 0.5-5 mm. At the discharge from the orifice 3 the emulsion flow is expanded transversely of its axis by the gas stream, whereby the flow takes a conical configuration and, finally, bursts under the effect of expanding gas.

Figure 2:
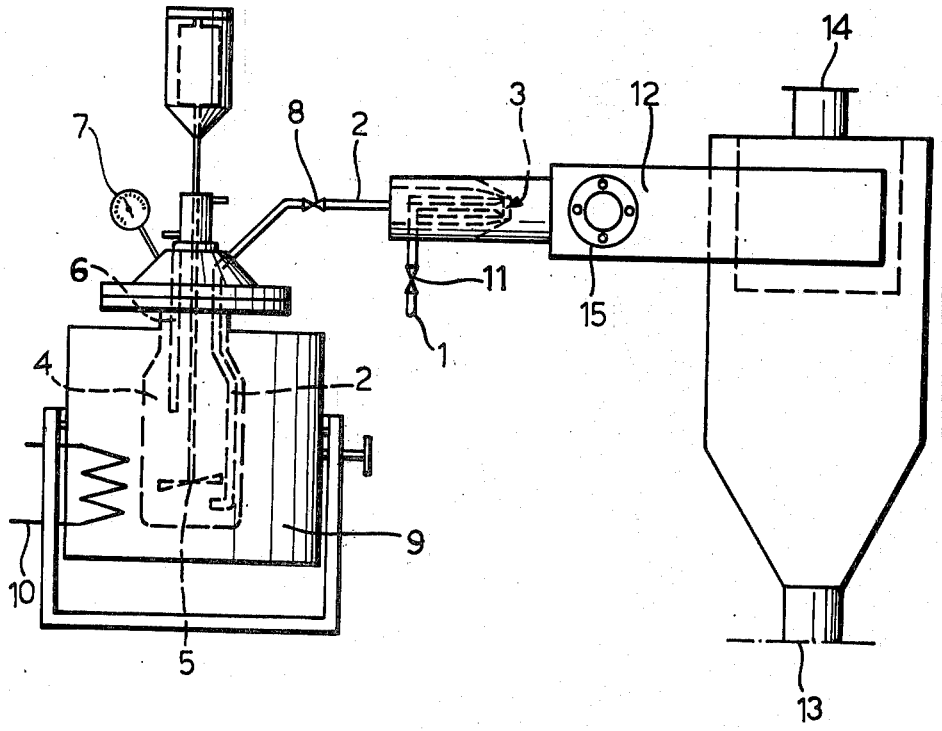

Referring to FIG. 2, the emulsion is prepared in a stainless steel autoclave 4, provided with a stirrer 5, such as a magnetically driven screw-propeller, a thermometer well 6, a pressure gauge 7 and a dipping steel tube 2 extending along the inner wall down to the bottom of the autoclave and connected by a flow regulating valve 8 with the spray orifice 3. The latter opens into an expansion chamber 12 which is of the cyclone type.

The autoclave can be heated by immersion into a bath 9 heated by electric resistors 10. The inert gas is supplied to the tube 1 and its flow is controlled by a valve 11.

When the emulsion has been prepared and heated, the flow control valves 8 and 11 are simultaneously opened and the "tube" of emulsion issuing from the orifice 3 "bursts" into the expansion chamber 12.

In this chamber the emulsion is spread in a finely subdivided state both as a result of the quick evaporation of the solvent and water and of the provision of the central stream of inert gas. The microfibrous pulp is thus formed, with the hereinbefore described properties, the pulp separating at the bottom 13 of the expansion chamber, from the top 14 of which nitrogen issues together with the solvent and water vapors.

A porthole 15 serves for visually controlling the spray.

The invention is further illustrated by the following examples.

EXAMPLE 1

The test was carried out by employing in accordance with FIG. 2 a stainless steel autoclave of a 5 liter content tested at a pressure of 300 atm, provided with a screw-propeller stirrer (600 rev/min) driven by a magnetic coupling, a well for the thermometer, a pressure gauge and a dipping L-shaped steel tube 8 mm in diameter extending along the inner wall down to the bottom of the autoclave. The spray nozzle as described with reference to FIGS. 1 and 2 was connected with the dipping tube and nitrogen feed line by two needle valves ⅜" in bore, which were opened simultaneously for spraying.

The size of the nozzle was as follows: diameter of the central nitrogen flow section 2 mm, cross-sectional area available for the tubular flow of the emulsion 1.9 sq.mm.

The autoclave was heated by means of electric resistors arranged in an oil bath surrounding the autoclave. A thermostatic control afforded an accuracy in adjustment of temperature of ±1° C. for temperatures up to 300° C.

The autoclave was charged in the following sequence: 1,000 g deionized water, 100 g high density polyethylene powder, 6 g of an ethylene-vinyl acetate copolymer containing 40% vinyl acetate, and 1,400 g heptane for industrial use of the type further described hereafter.

The high density polyethylene employed was a product having a melt index of 0.86 (ASTM-D 1238), an average molecular weight of 29,500, a density of 0.96 g/cu.cm and a melting point of 136.2° C.

The ethylene-vinyl acetate copolymer was the commercial product distributed under the trade name ELVAX-40 by Du Pont.

The heptane for industrial use was the distillation cut 92°-98° C. (ASTM-D 835) of a density of 0.71 g/ml, having the following composition:

| | |
|---|---|
| n-heptane | 21% |
| methylcyclopentane | 30% |
| iso-octanes (other than 2,2,4-trimethylpentane) | 14% |
| 3-methylhexane | 14% |
| 2,2,4-trimethylpentane | 8% |
| 1,3-cis,trans dimethylcyclopentanes | 9% |
| sulphur | 1-20 ppm |

traces of aromatic hydrocarbons and various hydrocarbons: balance to 100%.

Moreover, 2 g sorbitan polyoxyethylene monooleate of HLB=15 distributed under the trade name TWEEN-80 by Atlas Chemical Industries Inc. and 2 g sorbitan monooleate of HLB=4.3 distributed under the trade name SPAN-80 by Atlas Chemical Industries Inc. were added.

After tightly closing the autoclave, the system was brought in 150 minutes to a temperature of 193° C. by heating by means of the resistor in the bath outside the autoclave, whereby the pressure within the autoclave inherently rose to 22 atm.

Upon maintaining the above described conditions for 20 minutes, the valves connecting the nozzle to the tube dipping in the autoclave and to the feed line of nitrogen maintained at a pressure of 60 atm were simultaneously opened.

By the action of the pressure within the autoclave the emulsion streamed to the nozzle, and was sprayed into the expansion chamber maintained at atmospheric pressure and a temperature of 20°-25° C. The microfibrous product separated at the bottom of the chamber and nitrogen issued at the top together with the solvent and water vapors. The spraying period was 140 seconds. The nitrogen consumption was 0.18 N cu.m. per each liter of sprayed emulsion.

The resulting microfibrous pulp was easily suspendable in water and scarcely oriented, its crystallinity measured by X rays was below 50%. 30 parts by weight of the resulting microfibrous pulp were suspended in water and blended with 70 parts by weight refined birch cellulose (mode HUSUMBIRCH) with a degree of refining of 43° S.R. determined by the SHOPPER-RIEGLER apparatus.

The paper sheets obtained from this pulp by the conventional technique by means of a laboratory equipment of the RAPID-KEOTHEN type were fully similar in appearance to the sheets obtained still by the same RAPID-KOETHEN equipment when utilizing only the above-described cellulose.

The RAPID-KOETHEN apparatus is constructed following specific standards in order to produce paper sheets that are submitted to tests. The apparatus is described in the book "L'INDUSTRIA DELLA CARTA" by E. Gianni, Ed. Hoepli, Vol.I (p. 386-392).

Table 1 hereafter summarizes the average mechanical and optical properties of the sheets prepared as above. In Table 1, the fold resistance was determined following the TAPPI T 423 m/50 norm with an "ARMONIC" apparatus produced by TONIOLO, Milan. The other determinations are carried out following the ATICELCA methods, published by ATICELCA, Associazione Tecnica Italiana per la Cellulosa e la Carta, Milan. An apparatus of the ELREPHO type produced by ZEISS was used for the determination of whiteness.

Table 1

| | | ATICELCA method |
|---|---|---|
| weight (g/sq.m) | 59.8 | MC 3-68 |
| specific bulk volume (ml/g) | 1.15 | MC 4-68 |
| rupture length (m) | 6.670 | MC 2-68 |
| elongation at break (%) | 4.4 | MC 2-68 |
| burst strength (Kg/cm$^2$) | 2.46 | MC 6-68 |
| tear strength (g) | 54 | MC 7-68 |
| whiteness (ELREPHO) | 87.4 | MC 12-72 |
| opacity (%) | 74.0 | MC 13-72 |
| fold resistance (double folds) | 691 | — |

Sheets of microfibrous pulp alone separately prepared on the RAPID-KOETHEN equipment did not substantially differ in appearance either from those obtained from the blend containing 30% b.w. microfibrous pulp or from those obtained from cellulose pulp.

EXAMPLE 2

The apparatus of Example 1 was charged in the following sequence with 1,400 g deionized water, 100 g high density polyethylene in powder form and 1,400 g heptane for industrial use, all of the same type as in Example 1.

Moreover, 2 g sorbitan polyoxyethylene monooleate and 1 g sorbitan monooleate both of the same type as in Example 1 were added.

After tightly closing the autoclave, the system was brought in 120 minutes to a temperature of 193° C., whereby the pressure within the autoclave inherently rose to 22 atm.

Upon maintaining the above-described conditions for 15 minutes, the valves connecting the nozzle with the tube dipping into the autoclave and the supply line of nitrogen maintained at a pressure of 80 atm were simultaneously opened.

Spraying into the expansion chamber maintained at atmospheric pressure was effected in 150 seconds. The nitrogen consumption was 0.20 N cu.m. for each liter of sprayed emulsion.

The microfibrous pulp collected at the bottom of the cyclone was easily suspendable in water and scarcely oriented, its crystallinity measured by X ray being below 50%.

30 parts by weight of the resulting microfibrous pulp were suspended in water and blended with 70 parts b.w. refined birch cellulose (mode HUSUMBIRCH) of a refining degree of 43° S.R. determined by the SHOPPER-RIEGLER apparatus.

The paper sheets obtained from this mixed pulp in the same way as in Example 1 were quite similar in appearance to the sheets obtained by utilizing only cellulose as described above.

The following Table 2 summarizes the average mechanical and optical properties of the webs prepared as above:

Table 2

| | | ATICELCA method |
|---|---|---|
| weight (g/sq.m) | 60.6 | MC 3-68 |
| specific bulk volume (ml/g) | 1.19 | MC 4-68 |
| rupture length (m) | 5,340 | MC 2-68 |
| elongation at break (%) | 3.5 | MC 2-68 |
| burst strength (kg/cm$^2$) | 1.97 | MC 6-68 |
| tear strength (g) | 55 | MC 7-68 |
| fold resistance (double folds) | 395 | — |

In this case also the determinations were made by the methods indicated in Example 1.

Sheets from microfibrous pulp alone were separately prepared and did not substantially differ from either those obtained from the blend containing 30% by weight microfibrous pulp or those obtained from cellulose pulp.

EXAMPLE 3 (COMPARATIVE)

The test of Example 2 was accurately repeated but no nitrogen was fed to the spray nozzle.

After charging the components to the autoclave, the temperature of the system was brought in 120 minutes to 193° C., whereby the pressure within the autoclave rose to 22 atm.

Upon maintaining the above-described conditions for 15 minutes, only the valve connecting the nozzle to the tube dipping in the autoclave was quickly opened, the spray being of course still directed into the cyclone-type expansion chamber maintained at atmospheric pressure. The resulting product was in the form of a fibrous aggregate not easily divided into elementary microfibers without tedious mechanical operations.

In no case did the product have properties which would enable direct use in preparing aqueous suspensions, hence paper sheets.

EXAMPLE 4 (COMPARATIVE)

The test of Example 2 was repeated without charging water to the autoclave and without subsequently supplying nitrogen to the spray nozzle.

The autoclave was charged in the following sequence with 100 g high density polyethylene powder, 1,400 g heptane for industrial use and 1 g of the sorbitan monooleate used in Example 1.

After tightly closing the autoclave, the system was brought by heating in 90 minutes to a temperature of 193° C.

Upon maintaining the conditions described above for 15 minutes, only the valve connecting the nozzle to the tube dipping in the autoclave was quickly opened, the spray being still directed into the cyclone-type expansion chamber maintained at atmospheric pressure.

The resulting product was in the form of a fibrous mass of continuous structure, impossible to subdivide into elementary microfibers by conventional means, and was moreover swollen by the solvent to a considerable extent. Due to these properties, the product was not convertible to paper sheets by conventional paper-making techniques.

EXAMPLE 5

This run was carried out as in Example 1 and 2, with the difference that the high density polyethylene was a granulated product of a melt index=17.0 and density of 0.96 g/cu.m.

The equipment of Example 1 was charged in the following sequence with 1,400 g deionized water, 1.0 g of sorbitan polyoxyethylene monooleate of HLB=15, 100 g of the specified polyethylene and 1,400 g of heptane for industrial use.

At this stage the conditions of Example 2 were accurately repeated.

For the sake brevity the conditions imposed and those reached in the run are summarized hereafter:

| | |
|---|---|
| heating period | 130 minutes |
| residence period | 15 minutes |
| temperature reached | 193° C. |
| pressure reached | 22 atm |
| nitrogen pressure | 80 atm |
| nitrogen consumption | 0.13 N cu.m./liter emulsion |
| period of spraying | 130 seconds. |

A pulp was obtained consisting of microfibers easily suspendable in water, scarcely oriented, of a crystallinity measured by X rays below 50%.

30 parts by weight of the microfibrous pulp suspended in water were mixed with 70 parts by weight refined birch cellulose (mode HUSUMBIRCH) of a refining degree of 43° S.R. determined by the SHOPPER-RIEGLER apparatus.

The paper sheets obtained from this mixed pulp were quite similar in appearance to the sheets obtained by utilizing only the cellulose.

EXAMPLE 6

This run was carried out in accordance with the preceding example, however utilizing a high-density granulated polyethylene of a melt index=8.0 and density of 0.96 g/cu.cm.

The conditions were as follows:

| | |
|---|---|
| heating period | 135 minutes |
| residence period | 15 minutes |
| temperature reached | 193° C. |
| pressure reached | 22 atm |
| nitrogen pressure | 80 atm |
| nitrogen consumption | 0.15 N cu.m./liter emulsion |
| spraying period | 140 seconds. |

The resulting product was a pulp consisting of microfibers easily suspendable in water and scarcely oriented, of a crystallinity measured by X rays below 50%.

The paper sheets obtained from the blend comprising 70 wt.% cellulose pulp were quite similar in appearance to the sheets obtained by utilizing only the cellulose employed in the pulp blend.

EXAMPLE 7

This run was carried out still in accordance with the run described in Example 5, however employing a high-density granulated polyethylene of a melt index=0.4 and density of 0.96 g/cu.cm. The conditions imposed and reached were substantially as in the preceding Example 6.

The resulting product was a pulp consisting of microfibers easily suspendable in water and scarcely oriented, of a crystallinity measured by X rays below 50%. In this case also the paper sheets obtained from the blend comprising 70 wt.% cellulose pulp were quite similar in appearance to the sheets obtained by utilizing only the cellulose employed in the pulp blend.

EXAMPLE 8

This run was carried out in accordance with the run described in Example 7, however the autoclave was also charged, in addition to the same type of high density polyethylene, with an inert filler comprising titanium dioxide.

The charging sequence was: 800 g deionized water, 1,5 g sorbitan polyoxyethylene monooleate of HLB=15, 98 g polyethylene of Example 7, 2 g $TiO_2$ and 1,400 g of the heptane for industrial use.

The imposed and attained conditions were as follows:

| | |
|---|---|
| heating period | 100 minutes |
| residence period | 15 minutes |
| temperature reached | 193° C. |
| pressure reached | 22 atm |
| nitrogen pressure | 50 atm |
| nitrogen consumption | 0.15 N cu.m./liter emulsion |
| spraying period | 120 seconds. |

The resulting product was a pulp consisting of microfibers easily suspendable in water and scarcely oriented. In this case also the paper sheets obtained from the blend comprising 70 wt.% cellulose were quite similar in appearance to the sheets obtained by utilizing only the cellulose employed in the blend.

A sheet of paper made wholly from the microfibrous pulp and fused by hot calendering acquired the appearance of a conventional polyethylene film filled with opacifying agents.

EXAMPLE 9

Example 5 was accurately repeated; however, the autoclave was charged with 2 g sorbiton polyoxyethylene monooleate of HLB=15 and 200 g high density polyethylene of a melt index of 17 and a density of 0.96 g/cu.cm.

The conditions imposed and attained were as follows:

| | |
|---|---|
| heating period | 140 minutes |
| residence period | 15 minutes |
| temperature reached | 193° C. |
| pressure reached | 22 atm |
| nitrogen pressure | 150 atm |
| nitrogen consumption | 0.20 N cu.m./liter emulsion |
| spraying period | 160 seconds. |

The resulting product was a pulp consisting of microfibers substantially identical in properties with those of Example 5.

EXAMPLE 10

The equipment of Example 1 was charged in the following sequence with 1,400 g deionized water, 1 g of the sorbitan polyoxyethylene monooleate used in Example 1, 100 g granulated isotactic polypropylene of melt index=5.6 and density of 0.907, and 1,400 g of heptane for industrial use.

At this stage the run of Example 2 was exactly repeated.

The conditions imposed and reached were as follows:

| | |
|---|---|
| heating period | 120 minutes |
| residence period | 15 minutes |
| temperature reached | 193° C. |
| pressure reached | 22 atm |
| nitrogen pressure | 40 atm |
| nitrogen consumption | 0.13 N cu.m./liter emulsion |
| spraying period | 150 seconds |

The resulting product was a pulp consisting of scarcely oriented microfibers easily suspendable in water. On comparing them with those obtained under similar conditions from high density polyethylene the microfibers were found rather rigid.

The paper sheets obtained from the pulp blend comprising 30 wt.% microfibrous pulp and 70 wt.% cellulose of Example 2 were similar in appearance to sheets obtained by utilizing only the cellulose employed in the pulp blend.

EXAMPLE 11

This run was carried out in accordance with the preceding example. However, directly after introducing isotactic polypropylene and before adding heptane, 6 g copolymer of ethylene and vinyl acetate containing 40% vinyl acetate were introduced into the autoclave, the copolymer being the commercial product distributed under the trade name ELVAX-40 by Du Pont.

The conditions imposed and reached, respectively, were as follows:

| | |
|---|---|
| heating period | 120 minutes |
| residence period | 15 minutes |
| temperature reached | 193° C. |
| pressure reached | 22 atm |
| nitrogen pressure | 50 atm |
| nitrogen consumption | 0.12 N cu.m./liter emulsion |
| spraying period | 145 seconds. |

The resulting product was a pulp consisting of scarcely oriented microfibers easily suspendable in water. On comparing them with those obtained in the preceding example, these microfibers were found less rigid and very similar to those obtained under similar conditions from high density polyethylene.

The paper sheets obtained from the blend comprising 70 wt.% cellulose, as in the preceding example, were quite similar in appearance to the sheets obtained by utilizing only the cellulose employed in the blend.

EXAMPLE 12

This run was carried out in accordance with Example 10. However, instead of 100 g isotactic propylene of melt index 5.6, 50 g thereof and 50 g of granulated high density polyethylene of a melt index 0.4 and density 0.96 g/cu.cm. of Example 7 were added. The conditions imposed and reached, respectively, were as follows:

| | |
|---|---|
| heating period | 130 minutes |
| residence period | 15 minutes |
| temperature reached | 193° C. |

-continued

| | |
|---|---|
| pressure reached | 22 atm |
| nitrogen pressure | 80 atm |
| nitrogen consumption | 0.15 N cu.m./liter emulsion |
| spraying period | 14 seconds. |

The result was a pulp consisting of scarcely oriented microfibers easily suspendable in water.

The paper sheets obtained by the hereinbefore-described technique from a mixture comprising 70 wt.% cellulose were fully similar in appearance to the sheets from the cellulose alone.

EXAMPLE 13

The equipment of Example 1 was charged in the following sequence with 800 g deionized water, 1 g of the sorbitan polyoxyethylene monooleate used in Example 1, 100 g granulated low density polyethylene of a melt index 5.3, density 0.91 g/cu.cm. and melting point 102° C. (distributed by S.I.R. under the rade name SIRTENE) and 1,400 g of heptane for industrial use.

At this stage the run of Example 2 was repeated.

The conditions imposed and reached, respectively, were as follows:

| | |
|---|---|
| heating period | 160 minutes |
| residence period | 15 minutes |
| temperature reached | 193° C. |
| pressure reached | 22 atm |
| nitrogen pressure | 60 atm |
| nitrogen consumption | 0.12 N cu.m./liter emulsion |
| spraying period | 120 seconds. |

The resulting product was a pulp consisting of microfibers easily suspendable in water.

The paper sheets obtained by the hereinbefore-described technique from a blend comprising 70 wt.% cellulose were similar in appearance to the sheets produced from cellulose alone as employed in the blend, but their mechanical properties were not particularly high.

EXAMPLE 14

The run of the preceding example was repeated but 100 g low density polyethylene of a melt index 0.5, density 0.915 g/cu.cm. and melting point 132° C. (distributed by S.I.R. under the trade name SIRTENE) were employed.

The imposed and reached conditions, respectively, were substantially the same as in the preceding Example with the exception of the heating period of 150 minutes and nitrogen consumption of 0.13 N cu.m./liter emulsion.

The sheets obtained by the hereinbefore-described technique from the mixture comprising 70 wt.% cellulose were similar in aspect to the sheets from cellulose alone of the same type, but their mechanical properties were not particularly high.

EXAMPLE 15

The equipment of Example 1 was charged in the following sequence with 1,400 g deionized water, 1 g of the sorbitan polyoxyethylene monooleate of Example 1, 50 g isotactic polypropylene of melt index 5.6 of Example 10, 50 g low density polyethylene of melt index 5.3 of Example 13 and 1,400 g of the heptane for industrial use.

By proceeding as in Example 1 the conditions imposed and reached were as follows:

| | |
|---|---|
| heating period | 140 minutes |
| residence period | 15 minutes |
| temperature reached | 193° C. |
| pressure reached | 22 atm |
| nitrogen pressure | 80 atm |
| nitrogen consumption | 0.13 N cu.m./liter emulsion |
| spraying period | 130 seconds. |

Again a pulp was obtained consisting of scarcely oriented microfibers easily suspendable in water.

The resulting paper sheets obtained by the hereinbefore-described technique from a mixture comprising 70 wt.% cellulose were similar in aspect to the sheets from cellulose alone but their mechanical properties were not particularly high.

EXAMPLE 16

This run was carried out similarly to the preceding examples illustrating the invention by charging the equipment of Example 1 in the following sequence: 1,400 g deionized water, 1 g of the sorbitan polyoxyethylene monooleate of Example 1, 70 g high density polyethylene of melt index 0.4 of Example 7, 30 g isotactic polypropylene of melt index 5.6 of Example 10, 6 g ethylene-vinyl acetate copolymer of Example 11 and 1,400 g of heptane for industrial use.

The conditions imposed and reached were as follows:

| | |
|---|---|
| heating period | 140 minutes |
| residence period | 15 minutes |
| temperature reached | 193° C. |
| pressure reached | 22 atm |
| nitrogen pressure | 60 atm |
| nitrogen consumption | 0.13 N cu.m./liter emulsion |
| spraying period | 130 seconds. |

Again a pulp consisting of microfibers easily suspendable in water was obtained.

The resulting paper sheets made by the hereinbefore-described technique from the mixture comprising 70 wt.% cellulose were quite similar in appearance to the sheets from cellulose alone.

We claim:

1. A method for preparing an amorphous microfibrous pulp suitable for use in the manufacture of synthetic paper, comprising the steps of:

(a) forming an aqueous emulsion of a solution in an organic solvent of a polymerization product of at least one polymer having a molecular weight of from $10^3$ to $10^6$ selected from the group consisting of olefinic homopolymers, olefinic copolymers, copolymers of at least one olefinic monomer with at least one further monomer copolymerizable therewith and mixtures thereof;

(b) heating said emulsion above the melting point of the polymerization product;

(c) spraying the hot emulsion in the form of a tubular jet into a zone of expansion in which water and the organic solvent are evaporated from the spray;

(d) injecting into the cavity of the tubular jet substantially coaxially with the tubular jet a stream of inert gas to spread the jet transversely of the length of the jet in said zone of expansion.

2. The method of claim 1, wherein the aqueous emulsion contains from 5 to 35 wt.% of the polymerization product based on the organic solvent and from 0.2 to 2 kg of water for each liter of said solution.

3. The method of claim 1, wherein the aqueous emulsion contains from 7 to 15 wt.% of the polymerization product based on the organic solvent and 0.5 to 1.5 Kg of water for each liter of said solution.

4. The method of claim 1, wherein said olefins are selected from the group consisting of ethylene, propylene and 1-butene.

5. The method of claim 1, wherein said further monomers are selected from the group consisting of vinyl acetate and vinyl chloride.

6. The method of claim 1, wherein the organic solvent consists essentially of at least one organic compound selected from the group consisting of aromatic hydrocarbons, aliphatic hydrocarbons, alicyclic hydrocarbons and chlorinated hydrocarbons.

7. The method of claim 6, wherein the aromatic hydrocarbons are selected from the group consisting of benzene, toluene and xylene, the aliphatic hydrocarbons are selected from the group consisting of butanes, pentanes, hexanes, heptanes, octanes and their distillation cuts, the alicyclic hydrocarbons are selected from the group consisting of cyclohexane and methylcyclopentane and the chlorinated hydrocarbons are selected from the group consisting of dichloromethane and chloroform.

8. The method of claim 1, wherein said organic solvent is heptane or its distillation cut.

9. The method of claim 1, wherein the emulsion contains a surfactant in a proportion of from 0.2 to 5% by weight based on the weight of the polymerization product.

10. The method of claim 9, wherein said surfactant is a non-ionic surfactant.

11. The method of claim 10, wherein said non-ionic surfactant is selected from the group consisting of sorbitan polyoxyethylene monooleate, sorbitan monooleate and mixtures of both.

12. The method of claim 1, wherein the emulsion contains an inert filler of a grain size below 1 micron in a proportion not exceeding 20% by weight based on the weight of the polymerization product.

13. The method of claim 12, wherein said inert filler is at least one compound selected from the group consisting of calcium carbonate, talc and titanium dioxide.

14. The method of claim 1, wherein the emulsion contains a dyestuff, an antioxidant, an antistatic agent, a flame propagation retardant or a mixture thereof.

15. The method of claim 1, wherein said emulsion is maintained before spraying at a temperature from 150° to 250° C. and a pressure from 15 to 60 atmospheres, said zone of expansion being maintained at atmospheric pressure and at a temperature of 20°-25° C.

16. The method of claim 1, wherein the stream of inert gas is injected co-currently with the tubular jet of emulsion at the root region of the jet.

17. The method of claim 16, wherein the emulsion is conveyed up to the root region of the jet as a tubular flow encircling a separate central stream of inert gas, thus obtaining at the root region of the tubular jet of emulsion a central stream of inert gas in expanding contact with the tubular jet.

18. The method of claim 17, wherein the emulsion is conveyed as a concentrical annular stream encircling the separate stream of inert gas having a circular cross-section.

19. The method of claim 18, wherein the inert gas stream has at the root region of the jet a circular cross-section of from 0.5 to 5 mm in diameter and the concentrical stream of emulsion has a cross-sectional area of from 0.1 to 10 sq.mm.

20. The method of claim 1, wherein said inert gas stream is fed at a pressure from 20 to 200 Kg/sq.cm. and in a proportion of from 0.1 to 1 $Nm^3$ for each liter of emulsion.

21. The method of claim 20, wherein said inert gas is at a temperature of 20°-25° C.

22. The method of claim 20, wherein said inert gas is selected from the group consisting of helium, nitrogen and mixtures of both.

23. A method for preparing a microfibrous pulp suitable for use in the manufacture of synthetic papers, comprising the steps of forming an aqueous emulsion of a solution in an organic solvent of a polymerization product of at least one polymer having a molecular weight from $10^3$ to $10^6$ selected from the group consisting of olefinic homopolymers, olefinic copolymers, copolymers of at least one olefinic monomer with at least one further monomer copolymerizable therewith and mixtures thereof, said organic solvent consisting essentially of at least one compound selected from the group consisting of aromatic hydrocarbons, aliphatic hydrocarbons, alicyclic hydrocarbons and chlorinated hydrocarbons, said aqueous emulsion containing from 5 to 35% by weight of the polymerization product based on the organic solvent, from 0.2 to 2 kg water for each liter of said emulsion and a surfactant in a proportion from 0.2 to 5% by weight based on the weight of the polymerization product, heating said emulsion at a temperature from 150° to 250° C., said temperature being above the melting point of the polymerization product, maintaining said emulsion at a pressure from 15 to 60 atmospheres, spraying said emulsion in the form of a tubular jet into a zone of expansion while injecting into the cavity of the tubular jet substantially coaxially with the tubular jet a stream of inert gas, said stream of inert gas being fed at a pressure from 20 to 200 Kg/sq.cm. and in a proportion from 0.1 to 1 $Nm^3$ for each liter of emulsion and said zone of expansion being maintained at atmospheric pressure and at a temperature of 20°-25° C., thereby spreading the jet transversally of the length of the jet in said zone of expansion and evaporating said water and organic solvent from the spray.

* * * * *